US009011185B2

(12) United States Patent
Diessel

(10) Patent No.: US 9,011,185 B2
(45) Date of Patent: Apr. 21, 2015

(54) ELECTRICAL PLUG-IN CONTACT

(75) Inventor: Thorsten Diessel, Hiddenhausen (DE)

(73) Assignee: Phoenix Contact GmbH & Co. KG (DE)

( * ) Notice: Subject to any disclaimer, the term of this patent is extended or adjusted under 35 U.S.C. 154(b) by 195 days.

(21) Appl. No.: 13/643,040

(22) PCT Filed: Apr. 13, 2011

(86) PCT No.: PCT/EP2011/001836
§ 371 (c)(1),
(2), (4) Date: Oct. 23, 2012

(87) PCT Pub. No.: WO2011/131310
PCT Pub. Date: Oct. 27, 2011

(65) Prior Publication Data

US 2013/0040507 A1 Feb. 14, 2013

(30) Foreign Application Priority Data

Apr. 23, 2010 (DE) ..... 10 2010 018 242

(51) Int. Cl.
*H01R 13/05* (2006.01)
*H01R 9/24* (2006.01)
(Continued)

(52) U.S. Cl.
CPC ..... *H01R 13/055* (2013.01); *H01R 9/2491* (2013.01); *H01R 9/26* (2013.01); *H01R 13/428* (2013.01)

(58) Field of Classification Search
CPC ..... H01R 13/052; H01R 13/20; H01R 13/05; H01R 13/17; H01R 2101/00
USPC ..... 439/825, 709, 750, 46
See application file for complete search history.

(56) References Cited

U.S. PATENT DOCUMENTS 1,104,720 A * 7/1914 Turner ..... 439/825
1,671,540 A * 5/1928 Monteil ..... 29/874
(Continued)

FOREIGN PATENT DOCUMENTS

DE 1157683 11/1963
DE 2736664 2/1978
(Continued)

OTHER PUBLICATIONS

International Search Report for PCT/EP2011/001836, English translation attached to original, Both completed by the European Patent Office on Jun. 9, 2011, All together 5 Pages.

*Primary Examiner* — Abdullah Riyami
*Assistant Examiner* — Vladimir Imas
(74) *Attorney, Agent, or Firm* — Brooks Kushman P.C.

(57) ABSTRACT

An electrical plug-in contact, having a first region for electrical contact with an electrical connection and a second region for electrical contact with an electrical conductor, wherein the two regions are connected to each therein an electrically conductive manner. To provide a plug-in contact that has a simpler design and is more reliable in use, the second region is designed as a plug-in sleeve, in particular a cylindrical plug-in sleeve, which, in the contact region thereof with the electrical conductor, has an elongated hole parallel to the longitudinal axis of the plug-in sleeve, and a longitudinal slot located diametrically opposite of the elongated hole. Furthermore, a system is provided, consisting of an electrical plug-in contact and an electrical conductor, in particular a current bar, wherein an angular, in particular quadrangular, hole for receiving the, in particular cylindrical, plug-in sleeve in the inserted position thereof is formed in the electrical conductor.

16 Claims, 3 Drawing Sheets

(51) Int. Cl.

| | |
|---|---|
| ***H01R 9/26*** | (2006.01) |
| *H01R 13/428* | (2006.01) |

(56) References Cited

U.S. PATENT DOCUMENTS

| | | | | | |
|---|---|---|---|---|---|
| 2,980,883 | A | * | 4/1961 | Scheller | 439/872 |
| 3,065,450 | A | * | 11/1962 | Fieberg | 439/825 |
| 3,238,497 | A | * | 3/1966 | Zell et al. | 439/825 |
| 3,284,755 | A | * | 11/1966 | Mummey et al. | 439/552 |
| 3,292,132 | A | | 12/1966 | Murphy | |
| 3,418,623 | A | * | 12/1968 | Ruehlemann | 439/589 |
| 3,425,029 | A | * | 1/1969 | Zak | 439/825 |
| 3,428,935 | A | * | 2/1969 | Loose | 439/48 |
| 3,545,080 | A | * | 12/1970 | Evans | 29/874 |
| 3,588,789 | A | * | 6/1971 | Kailus | 439/732 |
| 3,614,715 | A | * | 10/1971 | Marx | 439/825 |
| 3,634,819 | A | * | 1/1972 | Evans | 439/825 |
| 3,676,927 | A | * | 7/1972 | Maier | 29/882 |
| 3,697,931 | A | * | 10/1972 | Achten | 439/430 |
| 3,818,569 | A | * | 6/1974 | Kinkaid et al. | 29/764 |
| 3,941,449 | A | | 3/1976 | Baumanis | |
| 4,130,328 | A | * | 12/1978 | Wessel | 439/75 |
| 4,384,757 | A | * | 5/1983 | Andrews et al. | 439/736 |
| 4,422,711 | A | * | 12/1983 | Wolowicz | 439/827 |
| 4,824,405 | A | * | 4/1989 | Derain | 439/807 |
| 4,955,827 | A | * | 9/1990 | Roy et al. | 439/595 |
| 5,004,438 | A | * | 4/1991 | Cabourne | 439/825 |
| 5,082,462 | A | | 1/1992 | Oswald, Jr. | |
| 5,199,908 | A | | 4/1993 | Sucheski | |
| 5,209,680 | A | * | 5/1993 | Fry | 439/825 |
| 5,452,512 | A | * | 9/1995 | Foley et al. | 29/874 |
| 5,620,345 | A | | 4/1997 | Macioce et al. | |
| 5,628,656 | A | * | 5/1997 | Macioce et al. | 439/851 |
| 5,662,503 | A | | 9/1997 | Castaldo | |
| 6,146,211 | A | * | 11/2000 | Okamoto et al. | 439/693 |
| 6,328,615 | B1 | * | 12/2001 | Safai | 439/851 |
| 6,682,357 | B2 | * | 1/2004 | Sikora et al. | 439/125 |
| 7,108,521 | B2 | * | 9/2006 | Watanabe et al. | 439/82 |
| 7,118,429 | B1 | * | 10/2006 | Fabian | 439/852 |
| 7,503,812 | B2 | * | 3/2009 | Arai | 439/752.5 |
| 7,658,657 | B1 | * | 2/2010 | Scanzillo et al. | 439/825 |
| 7,695,289 | B1 | * | 4/2010 | Sato et al. | 439/78 |
| 2011/0059658 | A1 | | 3/2011 | Eisert et al. | |

FOREIGN PATENT DOCUMENTS

| | | |
|---|---|---|
| DE | 29516504 | 12/1995 |
| DE | 102008014177 | 9/2009 |
| GB | 436173 | 10/1935 |
| GB | 2065993 | 7/1981 |

* cited by examiner

ELECTRICAL PLUG-IN CONTACT

CROSS-REFERENCE TO RELATED APPLICATION

This application is the U.S. national phase of PCT Appln. No. PCT/EP2011/001836 filed on Apr. 13, 2011, which claims priority to German Patent Application No. 10 2010 018 242.7 filed on Apr. 23, 2010, the disclosures of which are incorporated in their entirety by reference herein.

TECHNICAL FIELD

The present disclosure relates to an electrical plug-in contact, in particular a test adapter, as claimed in the preamble of claim 1, and to a system having an electrical plug-in contact as claimed in claim 11.

BACKGROUND AND SUMMARY

The present invention relates to an electrical plug-in contact, in particular a test adapter, as claimed in the preamble of claim 1, and to a system having an electrical plug-in contact as claimed in claim 11.

An electrical plug-in contact of this kind has already been known for a long time. The known electrical plug-in contact, which is in the form of a test adapter, has a first region for making electrical contact with a meter and has a second region for making electrical contact with an electrical conductor, with the longitudinal axes of the two regions running laterally offset and parallel in relation to one another. In this case, the first region is formed in the manner of a sleeve and the second region consists of three sheet metal strips which are riveted to one another. The first and the second region are soldered to one another and encapsulated with an insulation material, in particular plastic.

The present invention is based on the problem of specifying an electrical plug-in contact which is simpler in terms of design and more reliable in terms of application.

This problem is solved by an electrical plug-in contact having the features of claim 1. The dependent claims relate to advantageous developments of the invention.

A significant advantage of the electrical plug-in contact according to the invention is, in particular, that it is simple in terms of design and reliable in terms of application. The electrical plug-in contact according to the invention can therefore be produced more simply, and is consequently more cost-effective. On account of the special structural design of the plug-in sleeve of the electrical plug-in contact, the plug-in sleeve bears against the electrical conductor over a large surface area and therefore ensures good electrical contact between the electrical plug-in contact and the electrical conductor.

Although U.S. Pat. No. 2,980,883 already discloses equipping an electrical plug-in connector with an elongate hole in the region in which said electrical plug-in connector makes contact with an electrical conductor, the known plug-in connector does not exhibit the combination according to the invention of an elongate hole and a longitudinal slot which is situated diametrically opposite said elongate hole.

However, it is specifically this combination which advantageously leads to the plug-in contact according to the invention being uniformly cushioned when it is moved to the plugged-in position. The elongate hole and the longitudinal slot ensure symmetrical force absorption. The plug-in sleeve can deform elastically over a large area. As a result, the plug-in sleeve bears in an effective manner against the electrical conductor when the electrical plug-in contact is in the plugged-in position, and therefore a good electrically conductive connection is established, without the electrical plug-in contact being plastically, that is to say permanently, deformed in the process.

Furthermore, the production of the known plug-in connector is complicated and therefore cost-intensive. The known plug-in connector is not suitable for use as a test adapter either.

A further plug-in connector is known from DE 295 16 504 U1. The known plug-in connector has a pin contact connection and a corresponding socket connection. In this case, only the socket connection has two diametrically opposite longitudinal slots in the region in which contact is made between the pin contact connection and the socket connection. However, the manner of operation of the known socket connection is naturally fundamentally different from that of the electrical plug-in contact according to the invention. While the known socket connection has to expand when the pin contact connection is plugged in, the plug-in sleeve should compress in an elastic manner when the electrical plug-in contact according to the invention is moved to its plugged-in position.

The type, dimensioning and material of the electrical plug-in contact can be selected within wide suitable limits. The plug-in sleeve and/or the first region are/is advantageously cylindrical. The production of the plug-in sleeve is simplified in this way.

In principle, the dimensioning of the elongate hole and the arrangement of said elongate hole on the plug-in sleeve can be freely selected within wide suitable limits. The elongate hole expediently has an extension in the longitudinal axis direction of the plug-in sleeve of at least 3 times the extension of the plug-in sleeve perpendicular to the longitudinal axis.

An advantageous development makes provision for the longitudinal axes of the two regions to run laterally offset and parallel in relation to one another. As a result, it is possible to position a plurality of electrical plug-in contacts, in particular test adapters, in an extremely narrow space without the electrical connection, for example of a meter, to the first region of the respective electrical plug-in contact being made difficult in the process.

A particularly advantageous development of the electrical plug-in contact makes provision for the plug-in sleeve to have at least one latching recess or a latching hole laterally offset in relation to the elongate hole, said latching recess or latching hole being formed in such a way that the electrical plug-in contact, when it is in the plugged-in position, is latched to the electrical conductor. This ensures that the electrical conductor makes reliable contact with the electrical plug-in contact when the electrical plug-in contact is in the plugged-in position.

In principle, it is possible to provide just one single latching recess or one single latching hole on the latching sleeve. The latching recess or the latching hole is advantageously in the form of a pair, with the latching recesses or latching holes being situated diametrically opposite and being arranged perpendicular to the elongate hole and the longitudinal slot. In this way, the plug-in sleeve is not subject to mechanical loading on one side and there are no undesirable relative movements between the plug-in sleeve and the electrical conductor when the electrical plug-in contact is in the plugged-in position.

A particularly advantageous development of the two abovementioned embodiments makes provision for the elongate hole to have an, in particular symmetrical, constriction, which extends transverse to the longitudinal axis of the plug-in sleeve, in the region of the latching recess or of the latching hole. This ensures that the plug-in sleeve has enough material in the region of the latching recess or of the latching hole in order to allow for elastic deformation of the plug-in sleeve. Otherwise, insufficient material would undesirably lead to plastic deformation of the plug-in sleeve in the region of the elongate hole.

An advantageous development also makes provision for the elongate hole to have an extension perpendicular to the longitudinal axis of at least 40% of the plug-in sleeve in the regions without the constriction and, in the case of the above-mentioned embodiment, of at least 25% of the plug-in sleeve in the regions with the constriction. Elastic deformation of the plug-in sleeve over a wide range is possible in this way.

A particularly advantageous development makes provision for the plug-in sleeve to have a run-on slope at its free end. As a result, the force which is to be applied for moving the electrical plug-in contact to its plugged-in position is reduced.

An advantageous development makes provision for the first region and the second region to be integrally formed. The production of the electrical test adapter according to the invention is further simplified in this way since a joining process for mechanically connecting the first region to the second region is dispensed with.

A further particularly advantageous development makes provision for the plug-in sleeve and/or the first region to be in the form of a rolled sheet metal part. The production of the plug-in sleeve and/or of the first region is further simplified as a result.

The invention also relates to a system comprising an electrical plug-in contact as claimed in one of the preceding claims and comprising an electrical conductor, in particular a current bar.

In principle, the design and the relative arrangement of the electrical plug-in contact and the electrical conductor in relation to one another can be freely selected within wide suitable limits.

A particularly advantageous development of the system makes provision for a polygonal, in particular square, hole for accommodating the, in particular cylindrical, plug-in sleeve when said plug-in sleeve is in its plugged-in position to be formed in the electrical conductor. This ensures reliable contact is made between the electrical plug-in contact and the electrical conductor; this is particularly true in the case of electrical plug-in contacts in which the electrical plug-in contact and the electrical conductor are latched by means of the latching recesses or latching holes which are formed on the plug-in contact.

An advantageous development of the system makes provision for the dimensions of the elongate hole and those of the electrical conductor to be matched to one another in such a way that the elongate hole projects beyond both sides of the electrical conductor in the longitudinal axis direction of the plug-in sleeve when the plug-in contact is in the plugged-in position. This ensures that the electrical plug-in contact makes reliable contact with the electrical conductor.

A further advantageous development of the system makes provision for the dimensions of the latching recess or of the latching hole in the direction of the longitudinal axis and those of the electrical conductor to be matched to one another in such a way that there is play between the plug-in sleeve and the electrical conductor in the longitudinal axis direction of the plug-in sleeve when the electrical plug-in contact is in the plugged-in position. Manufacturing and production tolerances can be compensated for in this way. Furthermore, the play ensures that the electrical contact is made between the electrical plug-in contact and the electrical conductor in a desired manner by means of the electrical contact areas provided for this purpose, and not by means of the boundary areas of the latching recesses or latching holes.

As a result, it is also possible to make contact with a series of electrical conductors, in particular current bars, with different strengths and positions with a single type of electrical plug-in contact. Therefore, the variety of components is reduced in a desirable manner.

A further advantageous development of the system makes provision for the edge length of the polygonal hole to be 80% to 97% of the extension of the plug-in sleeve perpendicular to the longitudinal axis of said plug-in sleeve. As a result, the mechanical contact between the electrical plug-in contact and the electrical conductor is ensured without departing from the elastic deformation region of the plug-in sleeve.

DETAILED DESCRIPTION

The invention will be explained in greater detail below with reference to the drawings.

Figures 1A, 1B, 1C, 1D, 1E, 1F, 1G:
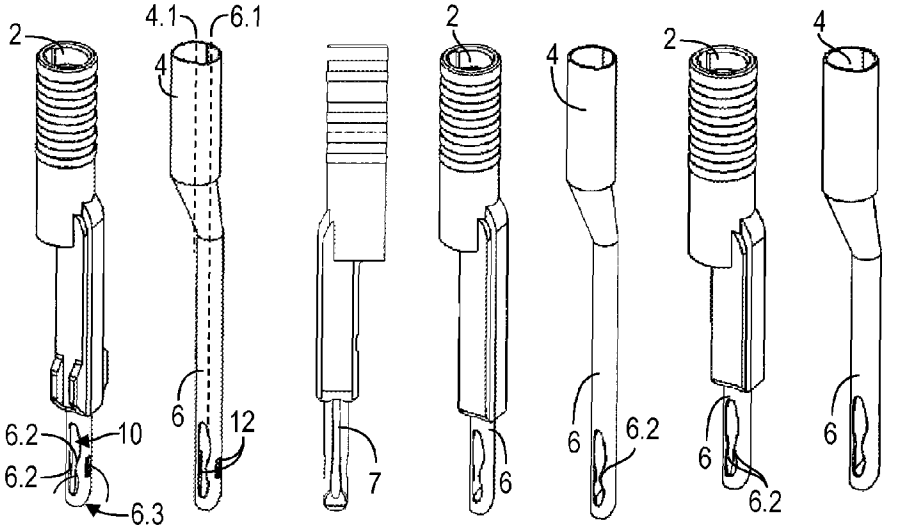
FIGS. 1A to 1G show seven exemplary embodiments of a plug-in contact according to the invention, respectively in a partial and a full perspective view.

FIGS. 1A to 1C show a first exemplary embodiment of an electrical plug-in contact according to the invention, with the plug-in contact, which is in the form of a test adapter, being illustrated in its entirety in the plane of the page on the left-hand side and being partially illustrated in the plane of the page on the right-hand side. The electrical test adapter has a handle 2 which is composed of an insulating material, in this case plastic. In this case, the handle 2 fully surrounds a first region 4 for electrical contact to be made by a meter (not illustrated) and partially surrounds a second region 6 for electrical contact to be made by an electrical conductor 8. The two regions 4, 6 are electrically conductively connected to one another. The longitudinal axes 4.1 and 6.1 of the two regions 4, 6 run laterally offset and parallel in relation to one another, this being explained in greater detail below. The first region 4 is in the form of a cylindrical sleeve in this case. The complete illustrations of the exemplary embodiments differ from the partial illustrations in that the handle 2 is included. This is also true of the exemplary embodiment according to FIGS. 5A and 5B.

The second region 6 is in the form of a cylindrical plug-in sleeve which has an elongate hole 10, which runs parallel to the longitudinal axis 6.1 of said cylindrical plug-in sleeve, in the region in which said cylindrical plug-in sleeve makes contact with the electrical conductor 8, with the dimensions of the elongate hole 10 and those of the electrical conductor 8 being matched to one another in such a way that the elongate hole 10 projects beyond both sides of the electrical conductor 8 in the longitudinal axis direction of the plug-in sleeve 6 when the test adapter is in the plugged-in position. See, in particular, FIGS. 3 and 4 in this respect.

The plug-in sleeve 6 has a longitudinal slot 7 diametrically opposite the elongate hole 10, with the longitudinal slot 7 running parallel to the elongate hole 10, that is to say likewise in the longitudinal axis direction of the plug-in sleeve 6. In this case, the longitudinal slot 7 can be designed both as a slot which is open on one side and as a slot which is open on two sides.

In order to produce the electrical test adapter in a simple manner, the first region 4 and the second region 6 are integrally formed, that is to say are produced from a single piece. In order to further simplify the production, the two regions 4, 6 are in the form of a rolled sheet metal part.

The plug-in sleeve 6 has a pair of latching holes 12 laterally offset in relation to the elongate hole 10, with the latching holes 12 being situated diametrically opposite and being arranged perpendicular to the elongate hole 10 and the longitudinal slot. The latching holes 12 are formed in such a way that the electrical test adapter latches with the electrical conductor 8 when it is in its plugged-in position. See, in particular, FIGS. 3 and 4 in this respect.

In the present exemplary embodiment, the elongate hole 10 has a symmetrical constriction 6.2, which extends transverse to the longitudinal axis 6.1 of the plug-in sleeve 6, in the region of the latching holes 12. In this case, the elongate hole 10 or the constriction 6.2 is dimensioned in such a way that the symmetrical borders of the elongate hole 10 do not touch in the region of the constriction 6.2 when the electrical test adapter is in the plugged-in position.

However, it is possible, in principle, for only one latching hole or more than two latching holes to be arranged on the plug-in sleeve 6. If the material of the plug-in sleeve 6 is thick enough, it is also feasible for one or more latching recesses, instead of one or more latching holes 12, to be formed in the plug-in sleeve 6.

Figure 2:
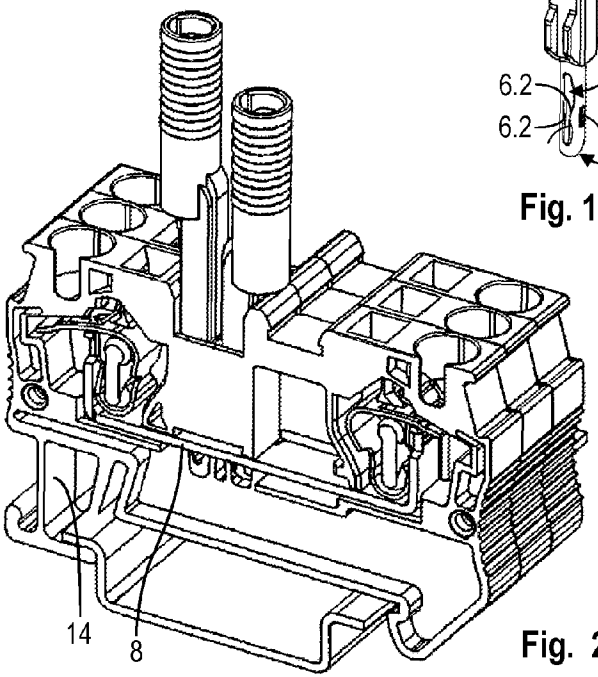
FIG. 2 shows the first exemplary embodiment from FIG. 1 in the plugged-in position.
Figure 4:
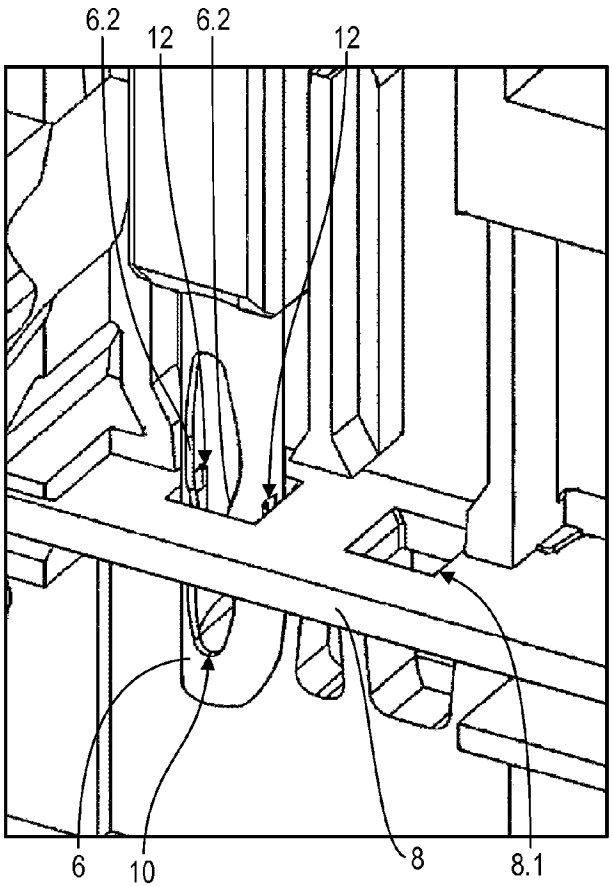
FIG. 4 shows an enlarged illustration of the framed region in FIG. 3.
Figure 3:
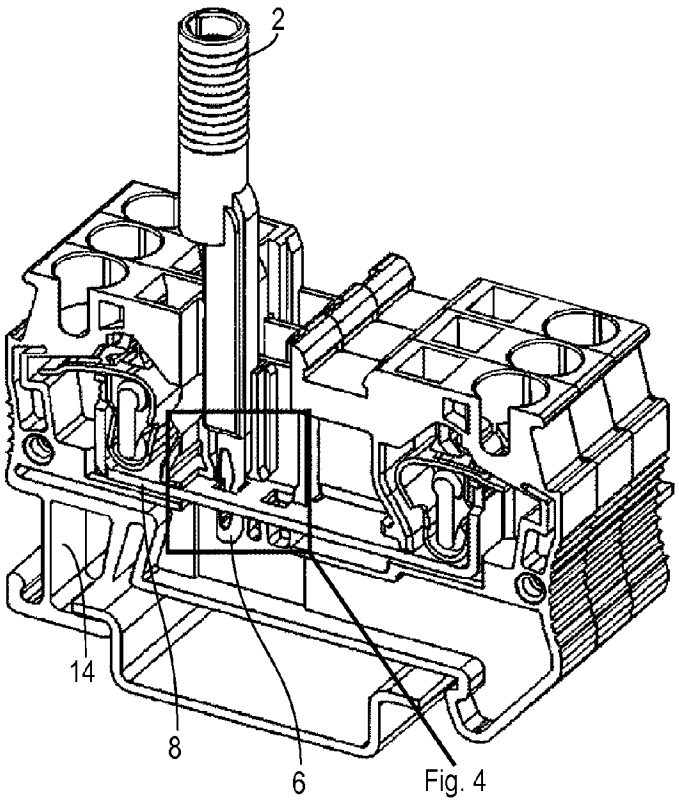
FIG. 3 shows the first exemplary embodiment in an analogous illustration to FIG. 2 in a partially sectioned view.

FIGS. 2-4 will be discussed in the text which follows in order to explain the first exemplary embodiment in greater detail.

FIG. 2 illustrates the electrical test adapter in its plugged-in position, with the electrical test adapter, in this case, being plugged into a terminal block 14 which is plugged onto a mounting rail in a manner known to a person skilled in the art by way of two further terminal blocks. As is clear from FIG. 2, the lateral offset of the longitudinal axes 4.1 and 6.1 of the two regions 4, 6 is therefore required in order to be able to connect a plurality of electrical test adapters in a narrow space to the respectively corresponding electrical conductor 8. In this case, the electrical plug-in contact forms, together with the electrical conductor 8 which is in the form of a current bar (also called a busbar) in this case, a system according to the invention.

FIG. 3 shows a partial section through the terminal block arrangement according to FIG. 2, with the region in which the plug-in sleeve 6 makes contact with the busbar 8 being emphasized in the drawing by being framed in FIG. 3. The framed region from FIG. 3 is illustrated on an enlarged scale in FIG. 4. The electrical test adapter is plugged into a hole 8.1 in the electrical conductor 8, which is in the form of a busbar, when said electrical test adapter is moved to its plugged-in position with the plug-in sleeve 6. In this case, the hole 8.1 is in the form of a polygonal, specifically a square, hole 8.1. In order to move the electrical test adapter to its plugged-in position in a force-saving manner, the plug-in sleeve 6 has a run-on slope 6.3 at its free end.

As is clear from FIG. 4, the plug-in sleeve 6 deforms elastically in the region in which it makes contact with the electrical conductor 8 on account of the elongate hole 10 and the longitudinal slot when the electrical test adapter moves to the plugged-in position, with the result that the plug-in sleeve 6 bears closely by way of its outer contour against the inner wall of the busbar 8, said inner wall delimiting the hole 8.1. When the electrical test adapter is in the plugged-in position, the walls of the plug-in sleeve 6 which delimit the latching holes 12 surround both sides of the busbar 8 such that a releasable latching connection is established between the electrical test adapter and the electrical conductor 8 which is in the form of a busbar. As is clear from FIG. 4, the dimensions of the latching holes 12 in the plug-in sleeve 6 in the direction of the longitudinal axis 6.1 and those of the electrical conductor 8 are matched to one another in such a way that, when the electrical test adapter is in the plugged-in position, the plug-in sleeve 6 surrounds the electrical conductor 8 by way of the walls, which delimit the latching holes 12, in the longitudinal axis direction of the plug-in sleeve 6 with play.

In the first exemplary embodiment present here, the elongate hole 10 has an extension in the longitudinal axis direction of the plug-in sleeve 6 of at least 3 times the extension of the plug-in sleeve 6 perpendicular to the longitudinal axis 6.1. In this case, the elongate hole is 8.23 mm long and at a distance of 1.3 mm from the free end of the plug-in sleeve 6, while the plug-in sleeve 6 has an outside diameter of 2.4 mm. In this case, the extension of the elongate hole 10 perpendicular to the longitudinal axis 6.1 is at least 40% of the plug-in sleeve 6 in the regions without the constriction 6.2 and at least 25% of the plug-in sleeve 6 in the regions with the constriction 6.2. With respect to the plane of the page of FIG. 4, the elongate hole 10 has a width of 1.4 mm above the constriction 6.2 and of 1.1 mm below the constriction 6.2. The width of the elongate hole 10 is still 0.7 mm at the constriction 6.2. In this case, the edge length of the polygonal hole 8.1 is 80% to 97% of the extension of the plug-in sleeve 6 perpendicular to the longitudinal axis 6.1 of said plug-in sleeve. The hole 8.1 is rectangular in this case, with the relatively short edges having an edge length of 2.0 mm and the relatively long edges having an edge length of 2.3 mm. In this case, the latching holes 12 have a height of 2.2 mm, with the center point of each latching hole 12 being at a distance of 4.4 mm from the free end of the plug-in sleeve 6.

Figure 5B:
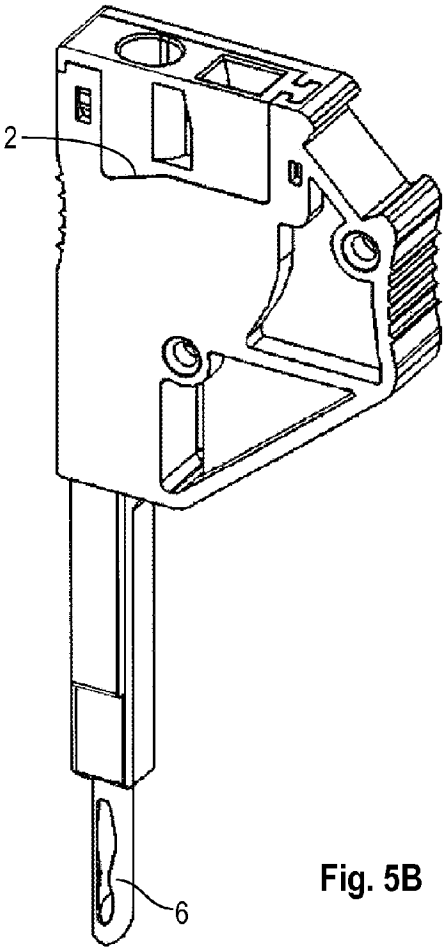
FIGS. 5A and 5B show a fourth exemplary embodiment of an electrical plug-in contact according to the invention.
Figure 5A:
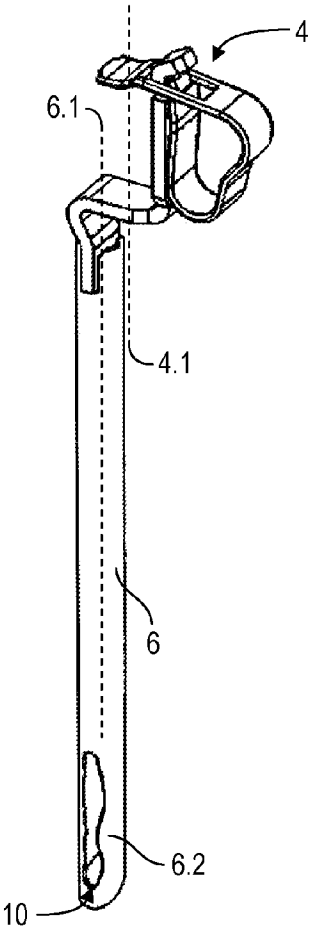

FIGS. 1D to 1G, and 5A to 5B illustrate three further exemplary embodiments of an electrical plug contact according to the invention. Only those aspects of these exemplary embodiments which differ from the first exemplary embodiment will be explained. Otherwise, reference is made to the detailed explanation provided in respect of the first exemplary embodiment. Identical or similar components are called the same name and labelled with the same reference symbols in the figures. In contrast to the three first exemplary embodiments, FIGS. 5A and 5B shows a partial illustration of the fourth exemplary embodiment on the left-hand side of the plane of the page and a complete illustration of said fourth exemplary embodiment on the right-hand side of the plane of the page.

The second exemplary embodiment according to FIGS. 1D and 1E differs from the first exemplary embodiment in that there are no latching holes arranged in the plug-in sleeve 6 in this case. The third exemplary embodiment according to FIGS. 1F and 1G differs from the second exemplary embodiment only in that the length of the plug-in sleeve 6 is shortened. The fourth exemplary embodiment according to FIGS. 5A and 5B does not have any latching holes either. Furthermore, in contrast to the abovementioned exemplary embodiments, the first region 4 of this exemplary embodiment is in the form of a spring-force clamping contact, with the first region 4 and the second region 6 being soldered to one another in this case in order to thereby establish an electrically conductive connection between the two regions 4, 6. Furthermore, this exemplary embodiment has a handle 2 which is matched in terms of structure to the spring-force clamping connection and is composed of insulating material, in this case plastic. The longitudinal axes 4.1 and 6.1 of the two regions 4, 6 run laterally offset and parallel to one another in this case too.

The invention is not limited to the described exemplary embodiments. Depending on the application, a person skilled in the art will modify and adapt the electrical plug-in contact within the limits of the invention. Furthermore, the invention is not restricted to the explicitly mentioned materials and connection techniques. A person skilled in the art will select these taking into consideration the specific application. The same is true of said electrical connections, in particular of the first region.

The invention claimed is:

1. An electrical plug-in contact, in particular a test adapter, having a first region for making electrical contact with an electrical connection and having a second region for making electrical contact with an electrical conductor, the two regions being electrically connected to one another, wherein the second region is in the form of a cylindrical plug-in sleeve having an elongate hole in the region in which said plug-in sleeve makes contact with the electrical conductor and in a manner running parallel to the longitudinal axis of said plug-in sleeve, and having a longitudinal slot located diametrically opposite said elongate hole.

2. The electrical plug-in contact as claimed in claim 1, wherein the elongate hole has an extension in the longitudinal axis direction of the plug-in sleeve of at least 3 times the extension of the plug-in sleeve perpendicular to the longitudinal axis.

3. The electrical plug-in contact as claimed in claim 1, wherein the longitudinal axes of the two regions run laterally offset and parallel in relation to one another.

4. The electrical plug-in contact as claimed in claim 1, wherein the plug-in sleeve has at least one latching recess or a latching hole laterally offset in relation to the elongate hole, said latching recess or latching hole being formed in such a way that the electrical plug-in contact, when it is in the plugged-in position, is latched to the electrical conductor.

5. The electrical plug-in contact as claimed in claim 4, wherein the latching recess or the latching hole is in the form of a pair, with the latching recesses or latching holes being situated diametrically opposite and being arranged perpendicular to the elongate hole and the longitudinal slot.

6. The electrical plug-in contact as claimed in claim 4, wherein the elongate hole has a symmetrical, constriction, which extends transverse to the longitudinal axis of the plug-in sleeve, in the region of the latching recess or of the latching hole.

7. The electrical plug-in contact as claimed in claim 1, wherein the elongate hole has an extension perpendicular to the longitudinal axis of at least 40% of the plug-in sleeve in the regions without the constriction and, in the case of an electrical plug-in contact as claimed in claim 6, of at least 25% in the regions with the constriction.

8. The electrical plug-in contact as claimed in claim 1, wherein the plug-in sleeve has a run-on slope at its free end.

9. The electrical plug-in contact as claimed in claim 1, wherein the first region and the second region are integrally formed.

10. The electrical plug-in contact as claimed in claim 1, wherein the plug-in sleeve and/or the first region are/is in the form of a rolled sheet metal part.

11. A system comprising an electrical plug-in contact as claimed in claim 1 and comprising an electrical conductor having a hole for accommodating the plug-in sleeve when said plug-in sleeve is in its plugged-in position.

12. The system as claimed in claim 11, wherein the dimensions of the elongate hole and those of the electrical conductor are matched to one another in such a way that the elongate hole projects beyond both sides of the electrical conductor in the longitudinal axis direction of the plug-in sleeve when the plug-in contact is in the plugged-in position.

13. The system as claimed in claim 11, wherein the plug-in sleeve has at least one latching recess laterally offset in relation to the elongate hole, the latching recess being formed in such a way that the electrical plug-in contact, when it is in the plugged-in position, is latched to the electrical conductor and wherein the dimensions of the latching recess in the direction of the longitudinal axis and those of the electrical conductor are matched to one another in such a way that there is play between the plug-in sleeve and the electrical conductor in the longitudinal axis direction of the plug-in sleeve when the electrical plug-in contact is in the plugged-in position.

14. The system as claimed in claim 11, wherein the edge length of the polygonal hole is 80% to 97% of the extension of the plug-in sleeve perpendicular to the longitudinal axis of said plug-in sleeve.

15. An electrical system comprising:

an electrical test adapter including a first region for making electrical contact with an electrical connection, and a second region for making electrical contact with an electrical conductor, the first and second regions being electrically connected to each other, wherein the second region is a cylindrical plug-in sleeve having an elongate hole in the region in which the plug-in sleeve makes contact with the electrical conductor and in a manner running parallel to a longitudinal axis of the plug-in sleeve, and having a longitudinal slot located diametrically opposite the elongate hole; wherein the electrical conductor has a hole for accommodating the plug-in sleeve when the plug-in sleeve is in a plugged-in position, the elongate hole and the electrical conductor being matched to one another such that the elongate hole projects beyond both sides of the electrical conductor in the longitudinal axis direction of the plug-in sleeve when the plug-in sleeve is in the plugged-in position.

16. An electrical system comprising:

an electrical test adapter including a first region for making electrical contact with an electrical connection, and a second region for making electrical contact with an electrical conductor, the first and second regions being electrically connected to each other, wherein the second region is a cylindrical plug-in sleeve having an elongate hole in the region in which the plug-in sleeve makes contact with the electrical conductor and in a manner running parallel to a longitudinal axis of the plug-in sleeve, and having a longitudinal slot located diametrically opposite the elongate hole, wherein the electrical conductor has a hole for accommodating the plug-in sleeve when the plug-in sleeve is in a plugged-in position, and wherein the plug-in sleeve has at least one latching recess laterally offset in relation to the elongate hole, the latching recess being formed in such a way that the electrical plug-in contact, when it is in the plugged-in position, is latched to the electrical conductor, and wherein the dimensions of the latching recess in the direction of the longitudinal axis and those of the electrical conductor are matched to one another in such a way that there is play between the plug-in sleeve and the electrical conductor in the longitudinal axis direction of the plug-in sleeve when the plug-in sleeve is in the plugged-in position.

* * * * *